US011274579B2

(12) United States Patent
Kucera et al.

(10) Patent No.: US 11,274,579 B2
(45) Date of Patent: Mar. 15, 2022

(54) ACTUATOR CONTROL SYSTEM FOR BI-STABLE ELECTRIC ROCKER ARM LATCHES

(71) Applicant: Eaton Intelligent Power Limited, Dublin (IE)

(72) Inventors: Pavel Kucera, Bavory (CZ); Petr Liskar, Prague (CZ); Pavel Fojtik, Frydek-Misteck (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/761,973

(22) PCT Filed: Nov. 2, 2018

(86) PCT No.: PCT/EP2018/080064
§ 371 (c)(1),
(2) Date: May 6, 2020

(87) PCT Pub. No.: WO2019/091874
PCT Pub. Date: May 16, 2019

(65) Prior Publication Data

US 2021/0189920 A1 Jun. 24, 2021

Related U.S. Application Data

(60) Provisional application No. 62/582,780, filed on Nov. 7, 2017.

(51) Int. Cl.
*F01L 1/34* (2006.01)
*F01L 9/21* (2021.01)
*F01L 9/26* (2021.01)
*F01L 1/18* (2006.01)

(52) U.S. Cl.
CPC ..... *F01L 9/21* (2021.01); *F01L 1/185* (2013.01); *F01L 9/26* (2021.01); *F01L 2009/2148* (2021.01); *F01L 2009/2163* (2021.01); *F01L 2820/031* (2013.01)

(58) Field of Classification Search
CPC ..... F01L 9/21; F01L 9/26; F01L 1/185; F01L 2009/2163; F01L 2009/2148; F01L 2820/031; F01L 13/0005; F01L 2001/186; F01L 2001/467; F01L 2013/001; F01L 2800/08; F01L 2301/00; F01L 2305/00
See application file for complete search history.

(56) References Cited

U.S. PATENT DOCUMENTS

2017/0241300 A1* 8/2017 Liskar ..... F01L 1/185

* cited by examiner

*Primary Examiner* — Zelalem Eshete
(74) *Attorney, Agent, or Firm* — Paul V. Keller

(57) ABSTRACT

An actuator control system suitable for providing single wire control of electromagnetic latch assemblies providing for cylinder deactivation or variable valve actuation in a valve-train system. The system is adapted to control electromagnetic latch assemblies that require DC current in a first direction for latching and DC current in a reverse of the first direction for unlatching. The actuator control system includes an inverting DC/DC converter and switching elements. In some embodiments, the inverting DC/DC converter uses capacitors to store energy that drives the inverted current. In some embodiments, the inverting DC/DC converter serves a plurality of distinct groups of the electromagnets.

17 Claims, 8 Drawing Sheets

ACTUATOR CONTROL SYSTEM FOR BI-STABLE ELECTRIC ROCKER ARM LATCHES

FIELD

The present teachings relate to valvetrains, particularly valvetrains providing variable valve lift (VVL) or cylinder deactivation (CDA).

BACKGROUND

Hydraulically actuated latches are used on some rocker arm assemblies to implement variable valve lift (VVL) or cylinder deactivation (CDA). For example, some switching roller finger followers (SRFF) use hydraulically actuated latches. In these systems, pressurized oil from an oil pump may be used for latch actuation. The flow of pressurized oil may be regulated by an oil control valve (OCV) under the supervision of an engine control unit (ECU). A separate feed from the same source provides oil for hydraulic lash adjustment. In these systems, each rocker arm assembly has two hydraulic feeds, which entails a degree of complexity and equipment cost. The oil demands of these hydraulic feeds may approach the limits of existing supply systems.

The complexity and demands for oil in some valvetrain systems can be reduced by replacing hydraulic actuators with electromagnetic actuators. Accordingly, there has long been an interest in electromagnetically actuated latches for rocker arm assemblies. Electromagnetic actuators latches require power. Rocker arms reciprocate rapidly over a prolonged period and in proximity to other moving parts. Wires attaching to a rocker arm could be caught, clipped, or fatigued and consequently short out.

SUMMARY

The present teachings relate to systems and methods for operating the valvetrain in an internal combustion engine of a type that has a combustion chamber, a moveable valve having a seat formed in the combustion chamber, a camshaft, and a rocker arm assembly that actuates the valve and includes and includes a rocker arm and a cam follower configured to engage a cam mounted on the camshaft as the camshaft rotates. The rocker arm assembly is configured such that rotation of the camshaft is operative to transmit force from the cam to the cam follower and move the rocker arm.

The rocker arm assembly may include a latch pin translatable between a first position and a second position. One of the first and second latch pin positions provides a configuration in which the rocker arm assembly is operative to actuate the moveable valve in response to actuation of the cam follower by the cam to produce a first valve lift profile. The other of the first and second latch pin positions provides a configuration in which the rocker arm assembly is operative to actuate the moveable valve in response to actuation by the cam follower by the cam to produce a second valve lift profile, which is distinct from the first valve lift profile, or the moveable valve is deactivated. This structure may provide cylinder deactivation (CDA) or variable valve lift (VVL).

The latch pin may be part of an electromagnetic latch assembly that includes an electromagnet and in which the latch pin is stable independently from the electromagnet in both the first and the second positions. The latch pin is actuated from the first position to the second position by providing the electromagnet with a current in a first direction. The latch pin is actuated from the second position to the first position by providing the electromagnet with a current in a second direction, which is the reverse of the first. One or more permanent magnets may stabilize the latch pin in both the first and second positions.

In some of the present teachings, the electromagnet is mounted to a rocker arm of the rocker arm assembly. In some of these teachings, the electromagnet is powered through an electrical connection made by abutment between two distinct parts, one of which is mounted to the rocker arm. Movement of the rocker arm may cause relative motion between contacting surfaces of the abutting parts.

Conventionally, an H-bridge would be used to provide DC current that is selectively either in a first direction or a second direction. An H-bridge would require connections to both terminals of the electromagnet. But the present teachings recognize that it is possible to reduce the wire count and the number of couplings by grounding one terminal of the electromagnet and providing an actuator control system that connects to the other terminal to drive the electromagnet with a DC current that is selectively either in a forward or a reverse direction. In some of these teachings, one terminal of the electromagnet is grounded through the structure of the rocker arm assembly. In some of these teachings, the ground connection is made to a cylinder head of an engine.

Some aspects of the present teachings relate to an actuator control system suitable for providing single wire control of the electromagnets in a valvetrain system. The actuator control system includes a DC/DC converter and switching elements. In some of these teachings, the DC/DC converter is coupled to the electromagnets through one or more half-bridge circuits. A half-bridge circuit is less expensive than an H-bridge circuit.

In some of these teaching the actuator control system, when coupled to a DC power source, is operative to provide current in either a first direction or a second direction, which is a reverse of the first, to the first terminals of any selected one of a plurality of distinct groups comprising one or more of the electromagnets. The current in the first direction may be provided by coupling the selected terminals directly to the power source. The current in the second direction is provided by the DC/DC converter. Accordingly, one DC/DC converter serves a plurality of electromagnet groups. This design relies on the latch pins associated with the various groups of electromagnets being actuated over brief and non-overlapping periods to reduce the number and size of components.

In accordance with some aspects of the present teachings, the DC/DC converter comprises one or more capacitors. The actuator control system may provide current in a first direction to the first terminals in a group of the electromagnets by coupling those terminals to a DC power source. The DC power source may also be used to charge the capacitors. The actuator control system draws down the capacitors to provide the first terminals of the electromagnets in the group with current in a second direction. Inverting DC/DC converters more commonly rely on inductors, where the energy for the reverse current is stored in the magnetic fields of the inductors. In the present design, energy for the reverse current is stored in the electric fields of the capacitors. The present teachings recognize that the timing of the valvetrain system allows for the use of a capacitor based DC/DC converter even when the actuator control system serves a plurality of groups of electromagnets. The capacitor based design reduces the number and complexity of parts.

Some aspects of the present teachings relate to a method of operating electromagnets in a valvetrain for an internal combustion engine of a type that has a combustion chamber, a moveable valve having a seat formed in the combustion chamber, and a camshaft. The electromagnets each have first and second terminals and each is operative to actuate a distinct group of one or more latch pins in rocker arm assemblies of the valvetrain. According to the method, over a first period the first terminals of a first set of the electromagnets are coupled to a DC power source to provide a current in a first direction to those terminals. Over a second period during which the DC power source is not coupled to the first terminals of the first set of the electromagnets, the DC power source is coupled to the first terminals of a second set of electromagnets, wherein the electromagnets in the second set are distinct from those in the first. The DC power source is also used to power a DC/DC converter. Over a third period, the DC/DC converter is coupled to the first terminals of the first set of the electromagnets and provides a current in a second direction to those terminals. The second direction is the reverse of the first. Over a fourth period during which the DC/DC converter is not coupled to the first terminals of the first set of the electromagnets, the DC/DC converter is coupled to the first terminals of the second set of the electromagnets. In some of these teachings, the DC/DC converter stores energy in one or more capacitors that drive the currents in the second direction.

Some aspects of the present teachings relate to another method of operating electromagnets in a valvetrain for an internal combustion engine of a type that has a combustion chamber, a moveable valve having a seat formed in the combustion chamber, and a camshaft. Each electromagnet is operative to actuate a distinct group of one or more latch pins. The method includes providing a first DC current from a power source to the first terminal of one of the electromagnets, wherein the first DC current actuates the latch pin from a first position to a second position; charging one or more capacitors with power from the power source; and providing a second DC current having an inverse polarity from the first DC current to the first terminal of the electromagnet. The second DC current is drawn from the one or more capacitors and the second DC current actuates the latch pin from the second position to the first position.

In some of these teachings, the actuator control system is installed in the engine along with the valvetrain. An engine control unit (ECU) may provide signals that that direct the actuator control system' provision of the currents in the forward and reverse directions. In some of these teachings, the DC/DC converter of the actuator control system exclusively serves the valvetrain system.

The primary purpose of this summary has been to present certain of the inventors' concepts in a simplified form to facilitate understanding of the more detailed description that follows. This summary is not a comprehensive description of every one of the inventors' concepts or every combination of the inventors' concepts that can be considered "invention". Other concepts of the inventors will be conveyed to one of ordinary skill in the art by the following detailed description together with the drawings. The specifics disclosed herein may be generalized, narrowed, and combined in various ways with the ultimate statement of what the inventors claim as their invention being reserved for the claims that follow.

DETAILED DESCRIPTION

FIG. 1-4 illustrate a valvetrain 100 with rocker arm assemblies 106. Rocker arm assemblies 106 include outer arms 103A, inner arms 1036, and cam followers 110. Valvetrain 100 is suitable for an internal combustion engine of a type that has combustion chambers, moveable valves having seats formed in the combustion chambers, and a camshaft. Rocker arm assemblies 106 may be installed in such an engine on pivots 140 in a configuration in which cams (not shown) on the camshaft engage cam followers 110 as the camshaft rotates. When rocker arms 103A and 103B are engaged, the action of the cams of the cam followers 110 is operative to actuate the moveable valves (not shown) via rocker arm assemblies 106.

Figure 1:
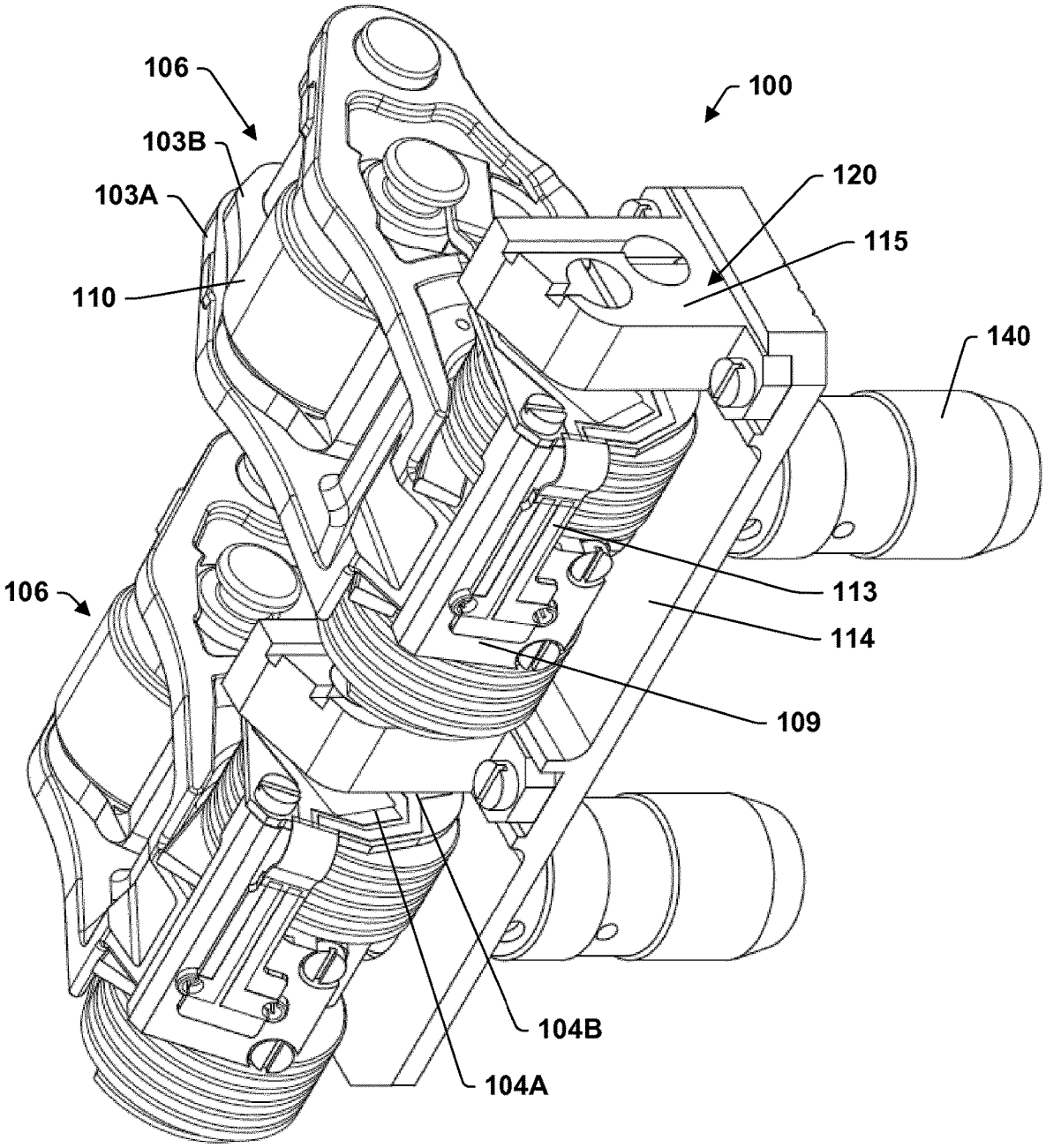
FIG. 1 is a perspective partial view of a valvetrain that may be modified and operated in view of the present teachings.
Figure 2:
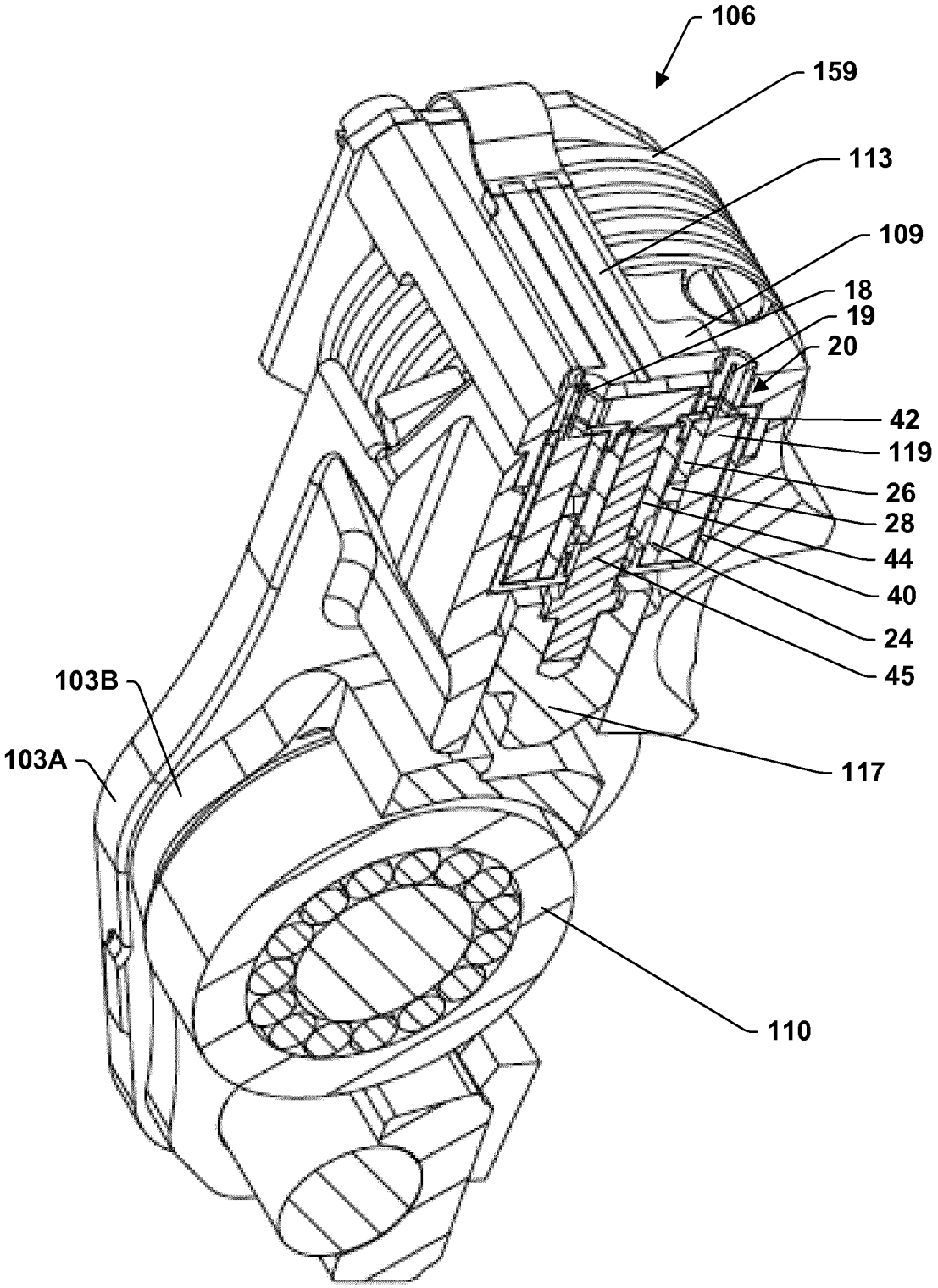
FIG. 2 is a perspective view showing a cross-section of one of the rocker arm assemblies in the valvetrain of FIG. 1.

Rocker arm assemblies 106 may be cylinder deactivating rocker arms. With reference to FIG. 2, cylinder deactivation is controlled by electromagnetic latch assemblies 20, one of which is mounted to each rocker arm assembly 106. Electromagnetic latch assemblies 20 each include a latch pin 117 that has extended and retracted positions. FIG. 2 shows latch pin 117 in the retracted position. When latch pin 117 is in the retracted position, rocker arms 103A and 103B are in a disengaged configuration. In the disengaged configuration, outer arm 103A may remain stationary even as inner arm 1036 is driven to pivot through cam follower 110. In this configuration, a valve actuated by rocker arm assembly 106 may be disabled. Latch pin 117 may be extended to place rocker arms 103A and 103B in an engaging configuration. In the engaging configuration, outer arm 103A may pivot in conjunction with inner arm 103B and a valve actuated by rocker arm assembly 106 may opened and closed in conjunction with actuation of rocker arm assembly 106 through cam follower 110. Providing additional cams that operate directly on outer arm 103A can convert rocker arm assembly 106 into a two-step rocker arm providing two alternative valve lift profiles.

Figure 5:
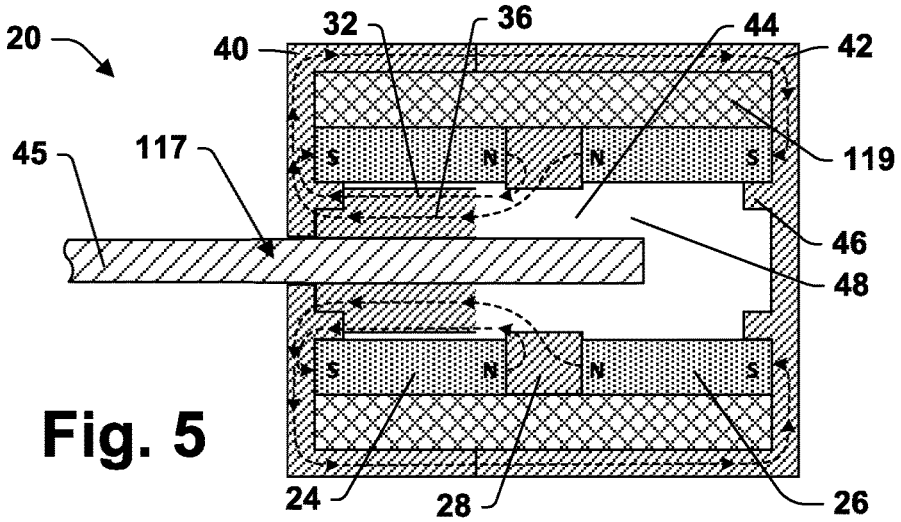
FIG. 5 is a cross-sectional side view of an electromagnetic latch assembly according to some aspects of the present teachings with the latch pin in an extended position.
Figure 6:
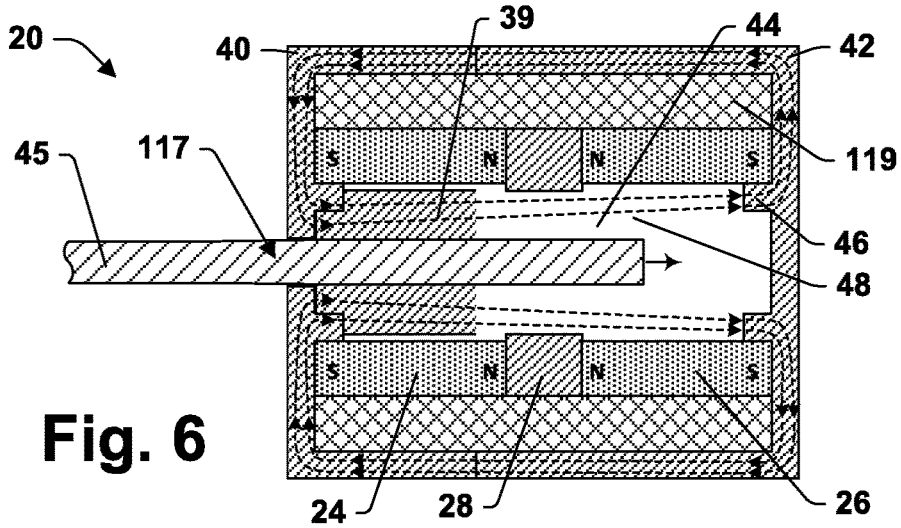
FIG. 6 provides the same view as FIG. 5, but illustrating magnetic flux that may be generated by the electromagnet.
Figure 7:
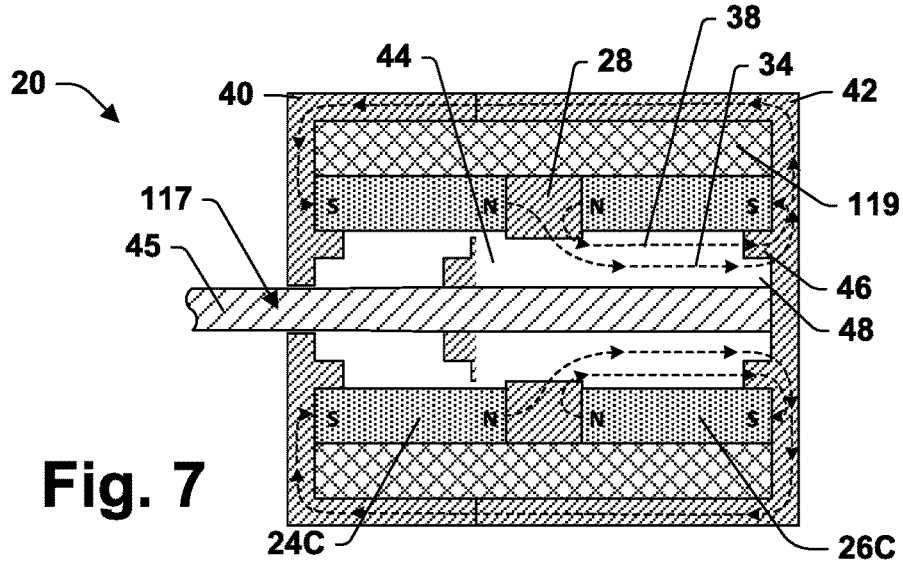
FIG. 7 provides the view of FIG. 5 but with the latch pin in a retracted position.

Electromagnetic latch assembly 20 includes permanent magnets 24 and 26, and an electromagnet 119, which is operative to actuate latch pin 117 between the extended and retracted positions. The operation of these components is illustrated by the sketches of FIGS. 5-7. FIG. 5 illustrates electromagnetic latch assembly 20 with latch pin 117 in the extended position, which is a first limit of travel for latch pin 117. FIG. 7 illustrates electromagnetic latch assembly 20 with latch pin 117 in the retracted position, which is a second limit of travel for latch pin 117. Electromagnet 119 is operative to cause latch pin 117 to translate between the extended and retracted positions. FIG. 6 illustrates the magnet field generated by electromagnet 119 to initiate the transition from the extended to the retracted position.

Permanent magnets 24 and 26 are each operative to stabilize the position of latch pin 117 in each of the extended and retracted positions. As illustrated in FIGS. 5 and 7, permanent magnets 24 and 26 utilize different magnetic circuits depending on whether latch pin 117 is in the extended or the retracted position. Pole pieces 40 and 42 form a clam shell around electromagnet 119, which completes some of these magnetic circuits. Latch pin 117 has a magnetically susceptible ferrule 44 around a paramagnetic core 45. Ferrule 44 is within these magnetic circuits and is the part through which permanent magnets 24 and 26 exert forces on latch pin 117. Magnetic circuits have characteristics as described herein, but it should be appreciated that the illustrations of these magnetic circuits are only approximate.

For the purposes of this disclosure, a paramagnetic material is one that does not interact strongly with magnetic fields. Aluminum is an example of a paramagnetic material. A magnetically susceptible material is generally a low coercivity ferromagnetic material. Soft iron is an example of a low coercivity ferromagnetic material. Pole pieces 28, 40, and 42 and ferrule 44 may all be made from soft iron.

As shown in FIG. 5, magnetic circuit 32 is the primary path for an operative portion of the magnet flux from magnet 24 when latch pin 117 is in the extended position, absent magnetic fields from electromagnet 119 or any external source that might alter the path taken by flux from magnet 24. The operative portion of the flux is that portion of the magnetic flux which contributes to the stability of latch pin 117 in its current position. Magnetic circuit 32 proceeds from the north pole of magnet 24, through pole piece 28, through ferrule 44, through an edge of pole piece 40, and ends at the south pole of magnet 24. Perturbation of latch pin 117 from the extended position would introduce an air gap into magnetic circuit 32, increasing its magnetic reluctance. The magnetic forces produced by magnet 24 resist such perturbations.

As shown in FIG. 7, when latch pin 117 is in the retracted position, magnetic circuit 34 is the primary path for an operative portion of the magnet flux from magnet 24. Magnetic circuit 34 proceeds from the north pole of magnet 24, through pole piece 28, through ferrule 44, through pole piece 42, through pole pieces 40, and ends at the south pole of magnet 24. Perturbations of latch pin 117 from the retracted position would introduce an air gap into magnetic circuit 34, increasing its magnetic reluctance. The magnetic forces produced by magnet 24 resist such perturbations.

Magnet 26 is also operative to stabilize latch pin 117 in both the extended and retracted positions. As shown in FIGS. 5 and 7, magnetic circuit 36 is the primary path for an operative portion of the magnet flux from magnet 26 when latch pin 117 is in the extended position and magnetic circuit 38 is the primary path for an operative portion of the magnet flux from magnet 26 when latch pin 117 is in the retracted position.

Electromagnetic latch assembly 20 is structured to operate through a magnetic flux shifting mechanism. In accordance with the flux shifting mechanism, electromagnet 119 is operable to alter the path taken by flux from permanent magnets 24 and 26. FIG. 6 illustrates the mechanism for this action in the case of operating electromagnet 119 to induce latch pin 117 to actuate from the extended position to the retracted position. Current through electromagnet 119 results in magnetic flux that follows the circuit 39. If the current has a suitable magnitude and direction, the flux reverses magnetic polarities in ferrule 44 and pole pieces 40 and 42. This greatly increase the reluctance of magnetic circuits 32 and 36 causing flux following those circuits to shift toward magnetic circuits 34 and 38. The net magnetic forces on latch pin 117 may drive it to the retracted position shown in FIG. 7.

Figure 3:
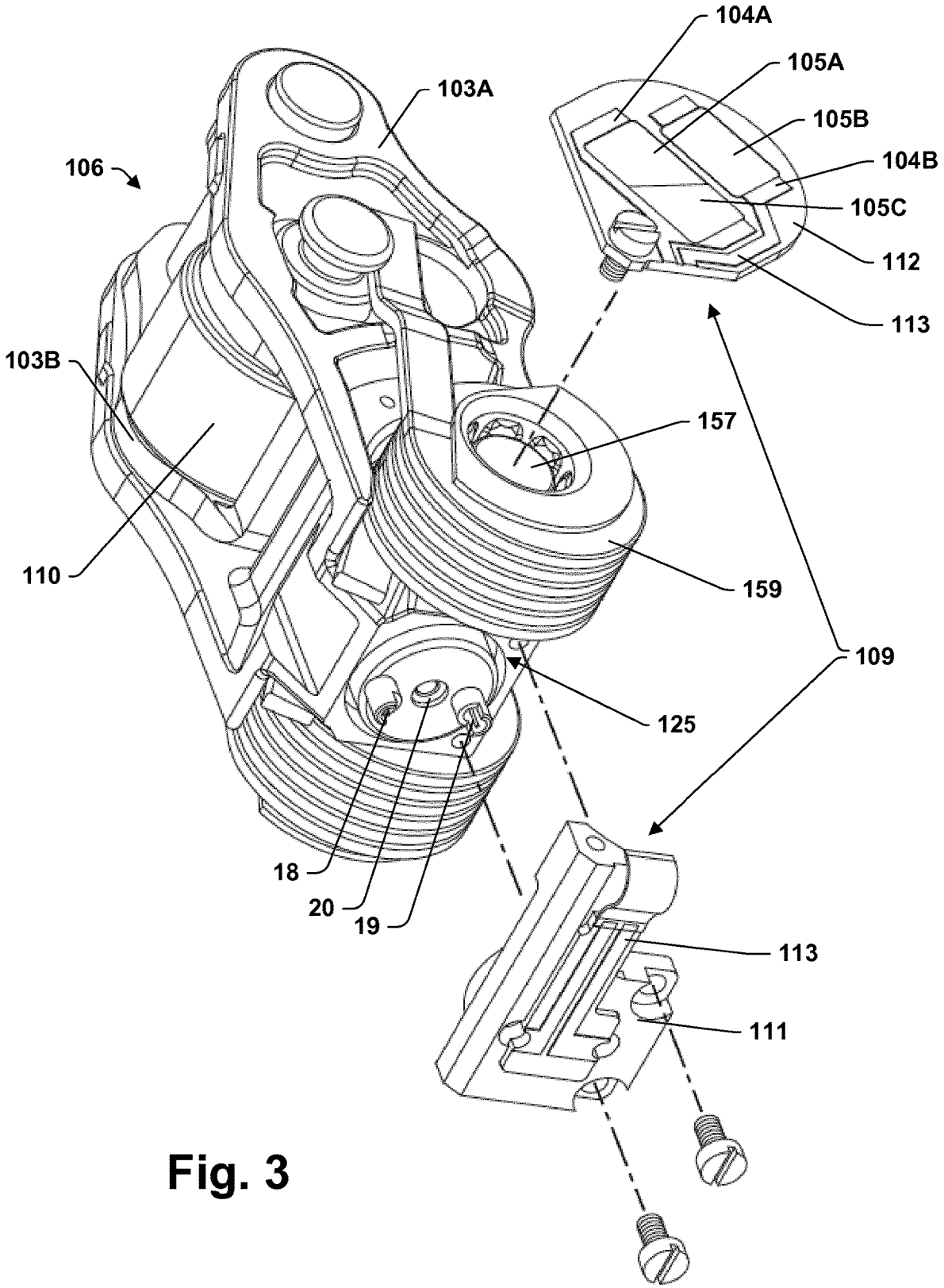
FIG. 3 is a partially exploded view illustrating the way in which contact pads are mounted to the rocker arm assembly of FIG. 2.

Referring to FIGS. 2 and 3, electromagnetic latch assembly 20, which includes electromagnet 119, may be installed in rocker arm 103A through opening 125 at the back of rocker arms 103A. Electromagnet 119 has a first terminal 18 and a second terminal 19. In the illustrated example, wires 113 couple first terminal 18 to contact pad 104A and second terminal 19 to contact pad 104B.

While contact pad 104B may be used to form a ground connection, the present teachings provide for an alternative configuration in which second terminal 19 is grounded by a connection to rocker arm 103A or another load-bearing component of rocker arm assembly 106. This alternative configuration eliminates the need for contact pad 104B and the electrical connection made through contact pad 104B.

Bracket 109, which may be press fit into opening 125, mounts contacts pads 104A and 104B to outer arm 103A and holds contacts pads 104A and 104B to one side of outer arm 103A over spring post 157. Bracket 119 may also support wires 113. Bracket 109 may include a part 111 held at the back of rocker arm 103A and a part 112 held to the side of rocker arm 103A. Optionally, parts 111 and 112 are provided as a single part. Such a part may be formed by over-molding wires 113 and contacts pads 104A and 104B.

Figure 4:
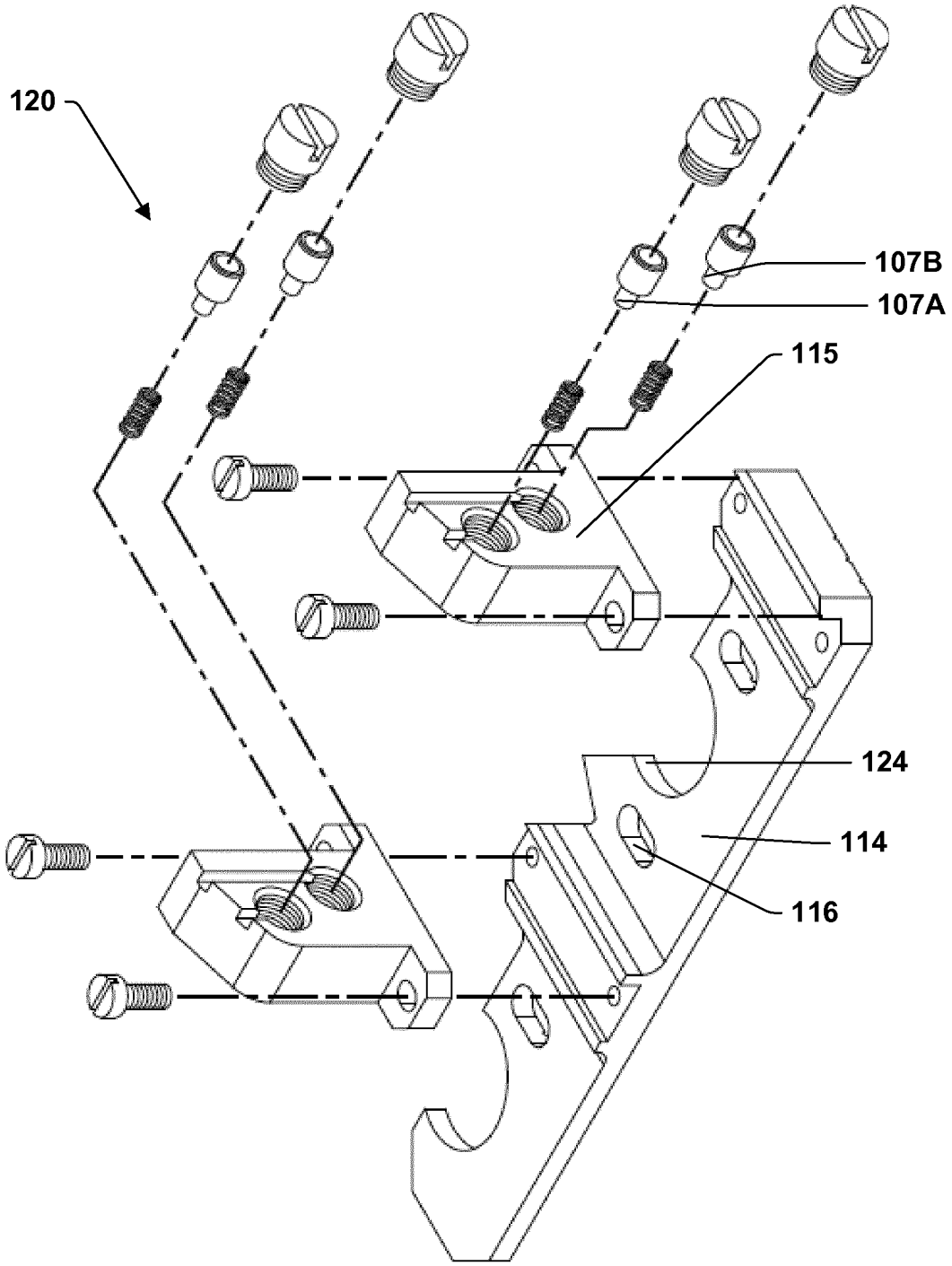
FIG. 4 is an exploded view of a mounting frame for spring-loaded contact pins that is part of the valvetrain of FIG. 1.

Electromagnet 119 may be powered through electrical connections formed by abutment between spring-loaded pins 107A and 107B and contact pads 104A and 104B. Contact pads 104A and 104B are mounted to rocker arm 103A and move in conjunction with rocker arm 103A. Spring-loaded pins 107A and 107B are mounted to components distinct from rocker arm assembly 106, whereby rocker arm 103A moves independently from spring-loaded pins 107A and 107B. Spring-loaded pins 107A and 107B are held against contact pads 104A and 104B respectively by framework 120. As shown in FIG. 4, framework 120 may include a base plate 114 and slip ring towers 115. Base plate 114 may include cutouts 124 that fit around pivots 140. When framework 120 is installed in an engine, baseplate 114 may rest atop a cylinder head (not shown) and abut two pivots 140. Cutouts 124 may cooperate with pivots 140 to ensure proper positioning of framework 120 with respect to rocker arm assemblies 106 and therefore proper position of spring-loaded pins 107 with respect to contact pads 104. Framework 120 may be secured to the cylinder head by bolts passing through openings 116. This structure holds spring-loaded pins 107 stationary relative to the cylinder head even as contact pads 104 pivot in relation to the movement of rocker arm 103A.

With reference to FIG. 3, contact pads 104A and 1046 have planar contact surfaces 105A and 105B respectively. Each rocker arm assembly 106 pivots on a pivot 140, which may be a hydraulic lash adjuster. Outer arm 103A and inner arm 103B are free to pivot relative to one-another except when they are engaged by latch pin 117. Pivot 140 may raise or lower rocker arm assembly 106 to adjust lash. These motions take rocker arm 103A in directions parallel to the plane in which the planar contact surfaces contact pads 104A and 104B are oriented. Accordingly, the electrical connections formed by abutment between contacts pads 104 and spring-loaded pins 107 may be maintained as outer arm 103A goes through its range of motion.

Spring-loaded pin 107B may remain in abutment with contact surface 1056 throughout rocker arm 103A's range of motion. Spring-loaded pin 107A may remain in abutment with contact surface 105A through only a portion of rocker arm 103A's range of motion. Contact pad 104A may be structured and positioned such that as rocker arm 103A is lifted off base circle, spring-loaded pin 107A moved from abutment with contact surface 105A to abutment with contact surface 105C. Connection through contact surface 105C may present a distinctly higher resistance than connection through contact surface 105A. The higher resistance may be provided by a coating on contact surface 105C that is not present on contact surface 105A. That coating may be a diamond-like carbon (DLC) coating. The difference in resistance may be used to detect the position of rocker arm 103A.

Any suitable structure may be used to mount contact pads 104 to rocker arm 103A. Likewise, spring-loaded pins 107 could be mounted to any suitable part that is distinct from rocker arm 103A. Spring-loaded pins 107 may be mounted to that distinct part by any suitable structure. Contact pads 104 may be the parts mounted to components distinct from rocker arm 103A while spring-loaded pins 107 may be mounted to rocker arm 103A. Pins 107 could be replaced by pins without springs. Contact pads 104 could be formed with leaf springs to bias pins 107 and contact pads 104 into abutment. Suitable contacts could also be formed with rollers or motor brushes. In general, there is at least one electrical connection formed by abutting surfaces one of which rolls or slides relative to the other in relation to rocker arm 103A being lifted by a cam. The present teachings are particularly useful when such a connection is present, but they extend to situations in which there is no such connection.

Electromagnet 119 is powered by circuitry that provides electromagnet 119 with DC current that is selectively either in a forward or a reverse direction. A conventional solenoid switch forms a magnetic circuit that include an air gap, a spring that tends to enlarge the air gap, and an armature moveable to reduce the air gap. Moving the armature to reduce the air gap reduces the magnetic reluctance of that circuit. Consequently, energizing a conventional solenoid switch causes the armature to move in the direction that reduces the air gap regardless of the direction of the current through the solenoid's coil or the polarity of the resulting magnetic field. As described above, however, the direction in which latch pin 117 is actuated depends on the polarity of the magnetic field generated by electromagnet 119, which in turn depends on the direction of current through electromagnet 119.

In the illustrated embodiment, two electrical connections are made to rocker arm 103A. To actuate latch pin 117 to the extended position, first terminal 18 of electromagnet 119 may be connected to a 12V power source while second terminal 19 of electromagnet 119 is connected to ground. To actuate latch pin 117 to the retracted position, the polarity of these connections may be reverse: first terminal 18 may be connected to ground while second terminal 19 is connected to a 12V power source. An H-bridge circuit would typically be used to implement that functionality. However, the present teachings provide circuits that allow second terminal 19 to always be grounded while still allowing electromagnet 119 to be powered with a DC current that is selectively either in a forward or a reverse direction.

Figure 8:
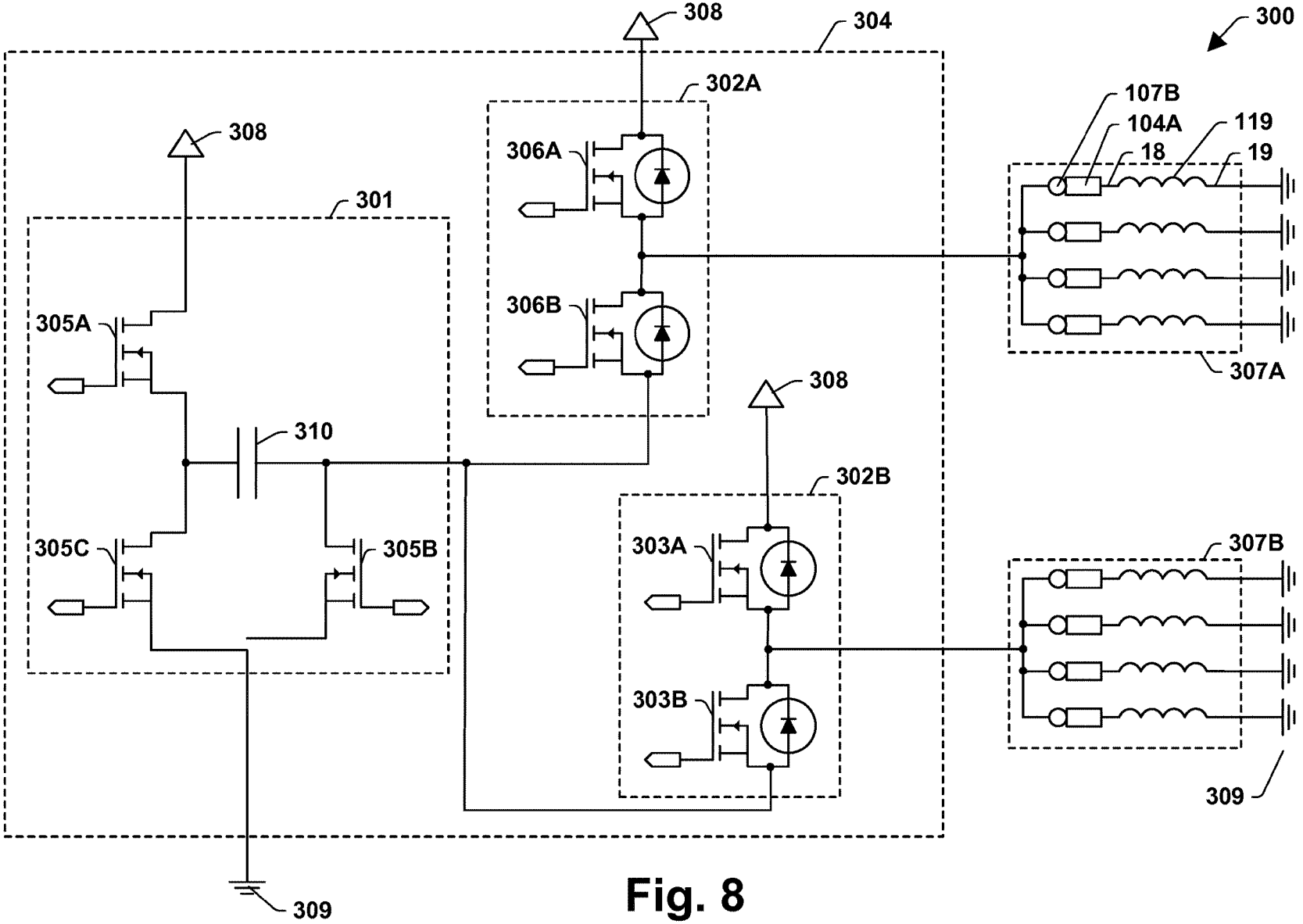
FIG. 8 provides a circuit diagram in accordance with some aspects of the present teachings.

FIG. 8 provides a drawing of a circuit 300 through which a plurality of electromagnets 119 may be powered in the desired manner. Circuit 300 includes impulse generator 301, half bridge circuit 302A, and half bridge circuit 302B, which together form actuator control system 304. When coupled to 12V DC power source 308, actuator control system 304 is operative to provide pulses of DC current in either a forward or a reverse direction to the electromagnets 119 in either a first group 307A or a second group 307B. In this example, the first group 307A corresponds to the valves for a first engine cylinder and the second group 307B the valves of a second engine cylinder. Accordingly, four valves associated with one or the other engine cylinder may be activated or deactivated simultaneously. The number of electromagnet groups, the way the electromagnets are grouped, and the number of electromagnets in each group may all be varied.

Impulse generator 301 is an inverting DC/DC converter. As used in the present disclosure, an inverting DC-to-DC converter is any electronic device that when powered by a DC current having a first polarity is operative to provide a DC current having second polarity, which is opposite that of the first. Impulse generator 301 includes capacitor 310 and switches 305A, 305B, and 305C. Capacitor 310 is charged by turning switches 305A and 305B on while keeping switch 305C off. While capacitor 310 is charging, actuator control system 304 may supply DC current in a first direction be transmitting that current from power source 308. When switches 305A and 305B are off and switch 305C is on, capacitor 310 may discharge to supply DC current in the second direction.

Figure 9:
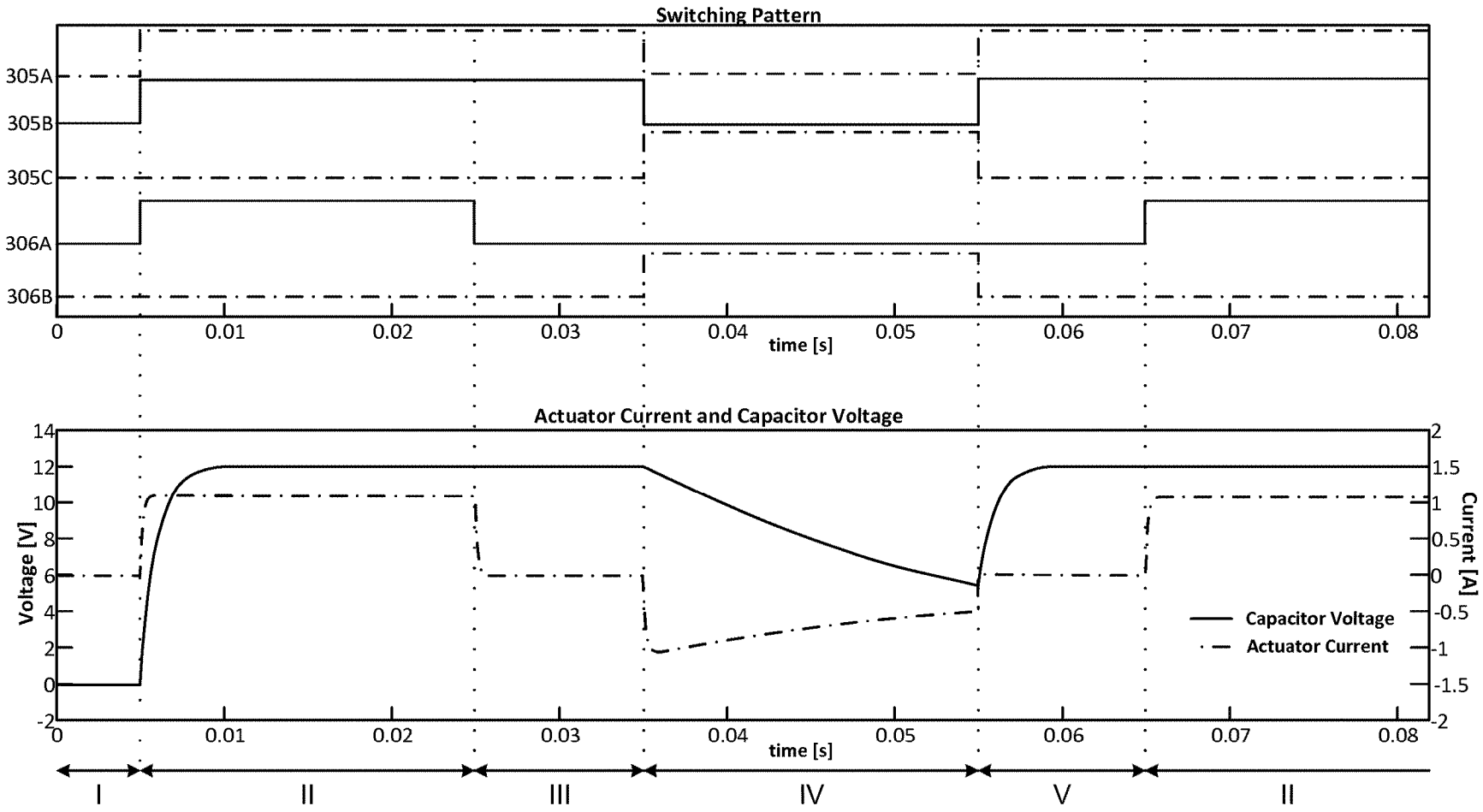
FIG. 9 provides plots illustrating the operation of an actuator control system in accordance with some aspects of the present teachings.

FIG. 9 provides plots illustrating the operation of impulse generator 301 and half bridge circuit 302A, and by extension, half bridge circuit 302B. The upper plot shows the switching pattern. The lower plot shows the time variation in voltage on the left hand side of capacitor 310 and of current provided actuator control system 304. During the initial period "I", all the switches are off and there is no current flow. For period "II", switches 305A, 305B, and 306A are on. Turning switch 306A on results in actuator control system 304 providing a positive current. Turning switches 305A and 305B on results in capacitor 310 being charged. For period "III", switch 306A is off. Switches 305A and 305B remain on and capacitor 310 continues to charge to the extent it is not fully charged already. Optionally, switches 305A and 305B are cycled on and off whenever capacitor 310 is charging to regulate its charging rate.

For period "IV" switches 305A, 305B, and 306A are off. Switches 305C and 306B are on. Switch 305C connects one side of capacitor 310 to ground 309. As capacitor 310 discharges, it pulls a negative current through switch 306B. As shown in FIG. 9, voltages on the left-hand side of capacitor 310 remain above ground. But voltages on the right-hand side of capacitor 310, and by extension at terminals 18 of electromagnets 119, are pulled below ground.

The magnitude of the negative current diminishes over period "IV". Capacitor 310 is sized to ensure that the current is sufficient to actuate a set of latches 117. Making the largest number of electromagnets in a group smaller would reduce the required size of capacitor 310. While the example shows four electromagnets per group, in some of these teachings the number of electromagnets 119 per group 307 is limited to two. In some of these teachings, the number of electromagnets 119 per group 307 is limited to one. For period "V", switches 305C and 306B are off, switches 305A and 305B are on, and capacitor 310 may once again be charged.

Figure 10:
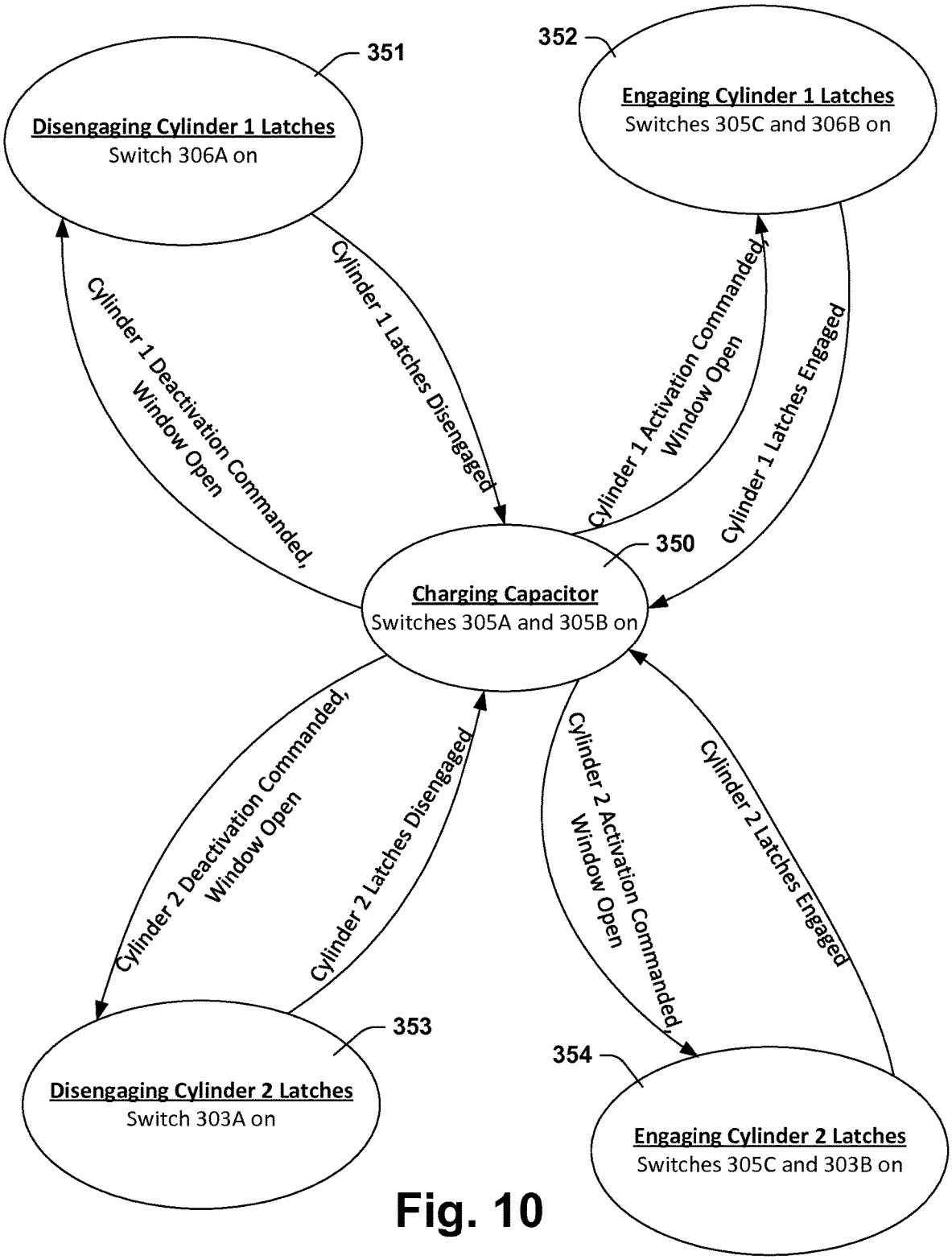
FIG. 10 is a finite state machine diagram for a method of operating a valvetrain system in accordance with some aspects of the present teachings.

FIG. 10 is a finite state machine diagram illustrating an example method of operating valvetrain 100 using latch control module 300. At the center is state 350, which may be the default state when valvetrain 100 is operating. In state 350, switches 305A are 305B are on and capacitor 310 is charging. All other switches are off.

A command to deactivate Cylinder 1 causes a transition to state 351. The transition may be delayed until all the rocker arm assemblies 106 associated with Cylinder 1 are within a switching window. A switching window may be a period in which latching or unlatching may be completed while all the cams operating on the rocker arm assemblies 106 are on base circle. In state 351, switch 306A is on. Optionally, switches 305A and 305B are kept on allowing capacitor 310 to continue to charge. All other switches are off. State 351 causes the latches 117 of the rocker arm assemblies 106 that control actuation of Cylinder 1's valves (not shown) to be disengaged, which deactivates Cylinder 1. After actuation is complete, latch control module 300 returns to the default state 350. The return to state 350 may be based on elapsed time or in any other suitable way. In some of these teachings, the return occurs within 0.1 second or less. Preferably, the return occurs within 0.05 seconds or less. More preferably, the return occurs without 0.02 seconds or less. State 353 is a counterpart to state 351 for deactivating Cylinder 2. State 353 is the same as state 351 except that switch 303A is on. Optionally, switches 305A and 305B are kept on allowing capacitor 310 to continue to charge.

A command to activate Cylinder 1 causes a transition to state 352. In state 352, switches 305C, and 306B are on. All other switches are off. State 352 causes the latches 117 of the rocker arm assemblies 106 that control actuation of Cylinder 1's valves to be re-engaged, which activates Cylinder 1. After actuation is complete, latch control module 300 again returns to the default state 350. State 354 is a counterpart to state 352 for reactivating Cylinder 2. State 354 is the same as state 352 except that switch 303B is on and switch 306B is off.

The components and features of the present disclosure have been shown and/or described in terms of certain embodiments and examples. While a particular component or feature, or a broad or narrow formulation of that component or feature, may have been described in relation to only one embodiment or one example, all components and features in either their broad or narrow formulations may be combined with other components or features to the extent such combinations would be recognized as logical by one of ordinary skill in the art.

The invention claimed is:

1. A valvetrain for an internal combustion engine of a type that has a combustion chamber, a moveable valve having a seat formed in the combustion chamber, and a camshaft, the valvetrain comprising:

a plurality of rocker arm assemblies, each comprising a rocker arm, a latch pin, and a cam follower configured to engage a cam mounted on a camshaft as the camshaft rotates;

a plurality of electromagnets each having first and second terminals and each operative to actuate a distinct one of the latch pins; and an actuator control system comprising a first electronic device and one or more switching elements;

wherein, when coupled to a DC power source, the actuator control system is operative to provide to the first terminals of any selected one of a plurality of distinct groups comprising one or more of the plurality of electromagnets a DC current that is selectively either in a first direction or a second direction;

the second direction is a reverse of the first direction;

the first electronic device is a device that when powered by a DC current having a first polarity is operative to provide a DC current having a second polarity, which is opposite that of the first polarity;

the first electronic device provides the DC current in the second direction;

the second terminals of the electromagnets are grounded; and the first electronic device comprises one or more capacitors operative to supply the DC current in the second direction.

2. The valvetrain of claim 1, wherein the actuator control system provides the DC current in the second direction from the first electronic device to the electromagnets through one or more half-bridge circuits.

3. An engine, comprising:

a cylinder head; and the valvetrain of claim 1;

wherein the second terminals of the electromagnets are grounded to the cylinder head.

4. The valvetrain of claim 1, wherein the second terminals are grounded through structures of the rocker arm assemblies.

5. The valvetrain claim 1, further comprising permanent magnets that retain the latch pins in both extended and retracted positions.

6. The valvetrain claim 1, wherein:

the electromagnets are mounted on the rocker arms;

electrical connections between the actuator control system and the electromagnets are made by abutment between surfaces of distinct parts, a first of which is mounted to the rocker arm bearing the electromagnet and a second of which is mounted to a distinct part such that the rocker arm assembly is operative to move the first of the abutting surfaces relative to the second in response to actuation of the rocker arm assembly through the cam follower; and the electrical connections are isolated from ground.

7. A valvetrain for an internal combustion engine of a type that has a combustion chamber, a moveable valve having a seat formed in the combustion chamber, and a camshaft, the valvetrain comprising:

a plurality of rocker arm assemblies, each comprising a rocker arm, a latch pin, and a cam follower configured to engage a cam mounted on a camshaft as the camshaft rotates;

a plurality of electromagnets each having first and second terminals and each operative to actuate a distinct one of the latch pins; and an actuator control system comprising a first electronic device and one or more switching elements operative to provide the first terminal of one of the electromagnets with a DC current that is selectively in either a first direction or a second direction;

wherein the second direction is a reverse of the first direction;

the first electronic device comprises one or more capacitors operative to provide the DC current in the second direction; and the second terminals are grounded.

8. The valvetrain of claim 7, wherein the actuator control system provides the DC current in the second direction from the first electronic device to the electromagnets through one or more half-bridge circuits.

9. An engine, comprising:

a cylinder head; and the valvetrain of claim 7;

wherein the second terminals of the electromagnets are grounded to the cylinder head.

10. The valvetrain of claim 7, wherein the second terminals are grounded through structures of the rocker arm assemblies.

11. The valvetrain of claim 7, further comprising permanent magnets that retain the latch pins in both extended and retracted positions.

12. The valvetrain of claim 7, wherein:

the electromagnets are mounted on the rocker arms;

electrical connections between the actuator control system and the electromagnets are made by abutment between surfaces of distinct parts, a first of which is mounted to the rocker arm bearing the electromagnet and a second of which is mounted to a distinct part such that the rocker arm assembly is operative to move the first of the abutting surfaces relative to the second in response to actuation of the rocker arm assembly through the cam follower; and the electrical connections are isolated from ground.

13. A method of operating electromagnets each having first and second terminals and each operative to actuate a distinct group of one or more latch pins in rocker arm assemblies in a valvetrain for an internal combustion engine of a type that has a combustion chamber, a moveable valve having a seat formed in the combustion chamber, and a camshaft, the method comprising:

over a first period, coupling a DC power source to the first terminals of a first set of the electromagnets to provide a current in a first direction to those terminals;

over a second period during which the DC power source is not coupled to the first terminals of the first set of the electromagnets, coupling the DC power source to the first terminals of a second set of the electromagnets, wherein the electromagnets in the second set are distinct from those in the first;

storing energy from the DC power source in a first electronic device;

over a third period, coupling the first electronic device to the first terminals of the first set of the electromagnets to provide a current in a second direction to those first terminals, wherein the second direction is a reverse of the first;

over a fourth period during which the first electronic device is not coupled to the first terminals of the first set of the electromagnets, coupling the first electronic device to the first terminals of the second set of the electromagnets; and keeping the second terminals grounded over the first period, the second period, the third period, and the fourth period.

14. A method according to claim 13, wherein:

wherein storing energy in the first electronic device comprises storing the energy in one or more capacitors of the first electronic device; and the current in the second direction is driven by the energy stored in the capacitors.

15. A method according to claim 14, wherein:

the current in the first direction actuates the latch pins from first positions to second positions; and the current in the second direction actuates the latch pins from the second positions to the first positions.

16. The method of claim 13, further comprising installing the first electronic device as part of the valvetrain.

17. The method of claim 13, wherein the first electronic device is used exclusively by the valvetrain.

* * * * *